US005875836A

United States Patent [19]

Nakamura

[11] Patent Number: 5,875,836

[45] Date of Patent: Mar. 2, 1999

[54] STRUCTURE FOR ATTACHING A FAN SHROUD TO A HEAT EXCHANGER

[75] Inventor: Katsumi Nakamura, Tokyo, Japan

[73] Assignee: Calsonic Corporation, Tokyo, Japan

[21] Appl. No.: 17,160

[22] Filed: Feb. 2, 1998

[30] Foreign Application Priority Data

Feb. 3, 1997 [JP] Japan ..... 9-020337

[51] Int. Cl.[6] ..... F01P 5/02

[52] U.S. Cl. ..... 165/122; 165/51; 165/78; 123/41.49; 180/68.1

[58] Field of Search ..... 165/121, 78, 122, 165/41, 51; 123/41.49; 180/68.1

[56] References Cited

U.S. PATENT DOCUMENTS 4,406,132 9/1983 Bolton et al. ..... 165/122 X

FOREIGN PATENT DOCUMENTS 170883 4/1989 Japan .

57815 3/1991 Japan ..... 165/122

*Primary Examiner*—Leonard R. Leo

*Attorney, Agent, or Firm*—Sughrue, Mion, Zinn, Macpeak & Seas, PLLC

[57] ABSTRACT

A structure for attaching a fan shroud so as to cover a core formed between a pair of tanks which are spaced a given distance away from and opposite to each other, the structure including a guide groove formed integrally in a tank body belonging to each of the pair of tanks; and guides which are formed on both sides of the fan shroud facing the pair of tanks, respectively.

8 Claims, 3 Drawing Sheets

STRUCTURE FOR ATTACHING A FAN SHROUD TO A HEAT EXCHANGER

BACKGROUND OF THE INVENTION

1. Field of the Invention

The present invention relates to a structure for attaching a fan shroud so as to cover the core of a heat exchanger.

2. Description of the Prior Art

A structure for attaching a fan shroud so as to cover the core of a heat exchanger such as that described in, e.g., Japanese Patent Publication No. Hei. 1-170883 has been known as an existing structure.

FIG. 5 shows the structure for attaching a fan shroud to a heat exchanger described in the foregoing document. This attachment structure comprises a radiator 1 which is a heat exchanger, a pair of tanks 2 which are spaced a given distance away from each other in the vertical direction, a core 3 interposed between the pair of tanks 2.

A side plate 4 is provided on each side of the core 3 in the lateral direction, and each lateral side 5*a* of the fan shroud 5 is fitted into a guide groove 4*a* formed in each of the side plates 4.

Such an existing structure for attaching a fan shroud to a heat exchanger comprises the side plate 4 provided on each side of the core 3, and the fan shroud 5 fitted into the guide grooves 4*a* formed, respectively, in the side plates 4. In this way, the existing attachment structure requires the additional side plates 4, resulting in an increase in the number of components.

With a view to reliably supporting the fan shroud 5, the rigidity of the attachment-structure must be improved by increasing the thickness of the side plate, increasing the weight of the attachment structure.

SUMMARY OF THE INVENTION

The present invention has been contrived in an effort to solve the foregoing problem, and the object of the present invention is to provide a structure which enables a fan shroud to be readily and reliably attached to a heat exchanger.

According to the present invention, there is provided a structure for attaching a fan shroud for covering a core formed between a pair of tanks which are spaced a given distance away from and opposite to each other so as to form a heat exchanger, comprising: a guide groove being formed integrally in a tank body forming each of the pair of tanks; and guides being formed on both sides of the fan shroud facing the pair of tanks respectively.

The guide of the fan shroud preferably comprises a resiliently deformable lock protuberance formed at a leading end of the guide, and the fan shroud has an insert stop formed at a rear end of the fan shroud.

Further, the guide of the fan shroud preferably comprises a resiliently deformable fitting protuberance for resiliently fitting into the guide groove of the tank body.

Still further, each of the tank bodies with the guide groove is integrally formed from aluminum by extrusion molding.

In the fan shroud attachment structure according to the present invention, the guides of the fan shroud are inserted, respectively, into the guide grooves integrally formed in the pair of tank bodies, thereby attaching the fan shroud to the heat exchanger.

In the fan shroud attachment structure, when the leading end of the guide of the fan shroud is inserted into the guide groove of the tank body, the lock protuberance is inserted into the guide groove while remaining in a depressed and resiliently deformed state, and when the insert stop provided at the rear end of the fan shroud comes into contact with the end face of the core at the end of the inserting action, the lock protuberance protrudes to thereby limit, in conjunction with the insert stop, the further movement of the fan shroud in the direction of the guiding action.

Further, in the fan shroud attachment structure, the fitting protuberance of the guide of the fan shroud is resiliently fitted into the guide groove of the tank body, thereby preventing vibrations in the fan shroud.

Still further, in the fan shroud attachment structure, each of the tank bodies is integrally formed from aluminum by extrusion molding. During the extrusion molding operation, the guide grooves are formed, respectively, in the tank bodies.

DETAILED DESCRIPTION OF THE PREFERRED EMBODIMENTS

With reference to the accompanying drawings, a preferred embodiment of the present invention will be described in detail hereinbelow.

Figure 1:
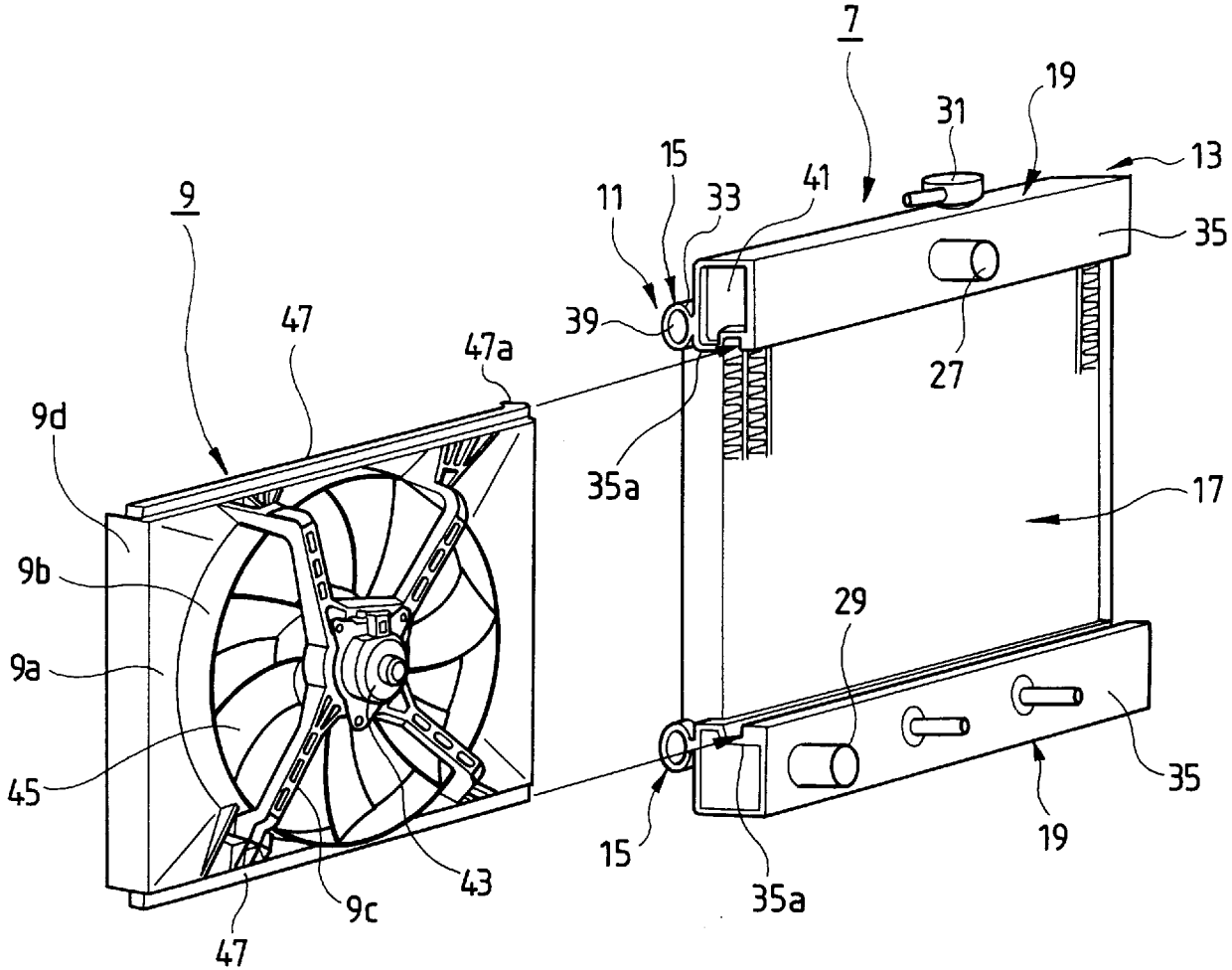
FIG. 1 is an exploded perspective view showing a structure for attaching a fan shroud to a heat exchanger according to one embodiment of the present invention.
Figure 2:
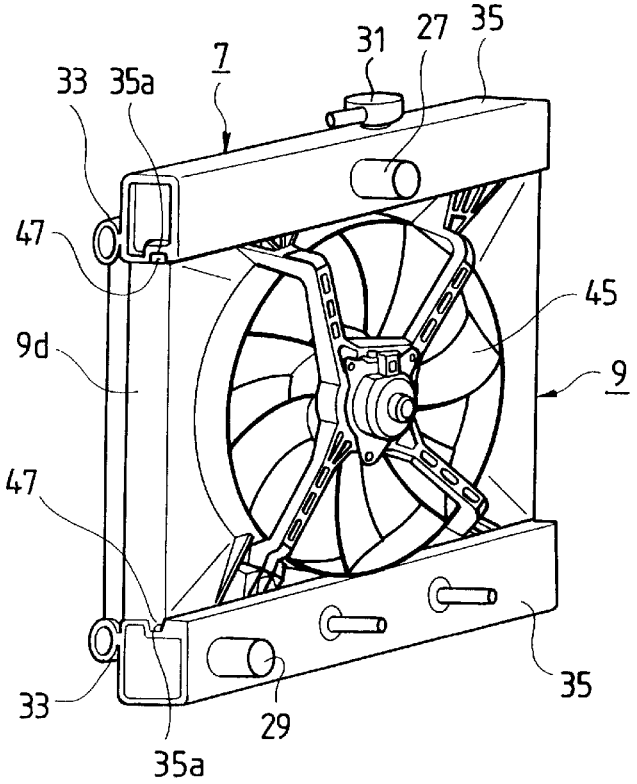
FIG. 2 is a perspective view showing the structure for attaching a fan shroud to a heat exchanger shown in FIG. 1.
Figure 3:
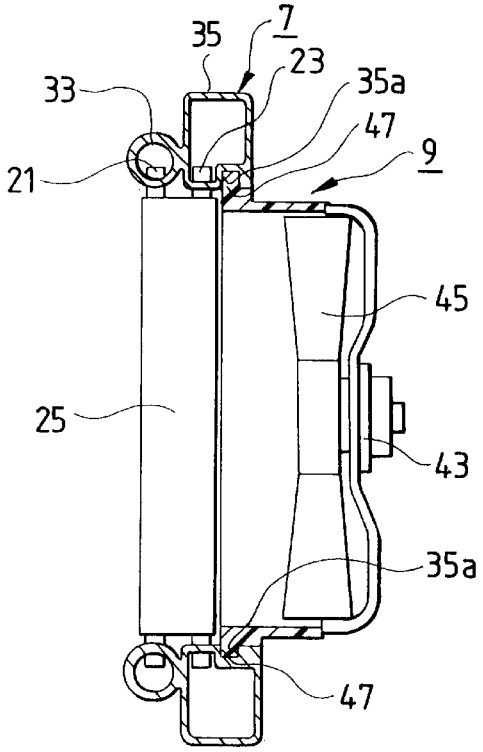
FIG. 3 is a longitudinal cross-sectional view of the fan shroud attachment structure shown in FIG. 2.

FIGS. 1 through 3 show a structure for attaching a fan shroud to a heat exchanger (hereinafter simply referred to as a fan shroud attachment structure) according to one embodiment of the present invention. In the drawings, reference numeral 7 designates an integrated heat exchanger, and reference numeral 9 designates a fan shroud.

In this integrated heat exchanger 7, a condenser 11 is disposed in front of a radiator 13.

The condenser 11 comprises a pair of first heat exchanger tanks 15 which are spaced a given distance away from and opposite to each other and a core 17 formed between the pair of heat exchanger tanks 15.

The radiator 13 comprises a pair of second heat exchanger tanks 19 which are spaced a given distance away from and opposite to each other and the core 17 formed between the pair of second heat exchanger tanks 19.

As shown in FIG. 3, tubes 21, 23 and corrugated fins 25 are alternately arranged in the core 17, and each of the corrugated fins 25 is shared between the tubes 21 and 23.

In this drawing, reference numerals 27 and 29 designate an inlet pipe and an outlet pipe, respectively. Further, reference numeral 31 designates a filler neck.

Reference numeral 33 designates a first tank body of the first heat exchanger tank 15, and reference numeral 35 designates a second tank body of the second heat exchanger tank 19.

Each of the first and second tank bodies 33 and 35 is integrally formed from aluminum by extrusion molding.

The first tank body 33 is cylindrically formed, and the second tank body 35 is rectanguraly formed.

The first and second tank bodies 33 and 35 are sealed at both ends thereof, respectively, by aluminum end plates 39 and 41.

The fan shroud 9 is formed from resin and has a rectangular shroud body 9*a*.

An annular shroud 9*b* is formed at the center of the shroud body 9*a*.

A fan 45 to be rotated by a motor 43 is disposed in the shroud 9*b* via brackets 9*c*.

In the pair of second heat exchanger tanks 19, guide grooves 35*a* are integrally formed in the respective sides of the second tanks 35 facing to each other.

The guide groove 35*a* has a rectangular cross section and is formed along the longitudinal side of the second tank body 35.

A guide 47 to be guided into the guide groove 35*a* of the second tank body 35 is integrally formed on each side of the fan shroud body 9*a* of the fan shroud 9 facing the second heat exchanger tank 19.

An insert stop 9*d* which protrudes toward the core 17 is integrally formed at the rear end of the shroud body 9*a*.

Figure 4:
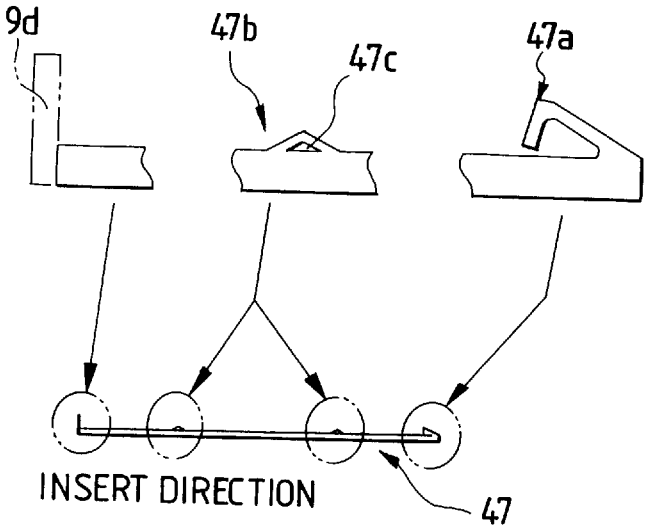
FIG. 4 is an explanatory view showing the details of a guide shown in FIG. 1.
Figure 5:
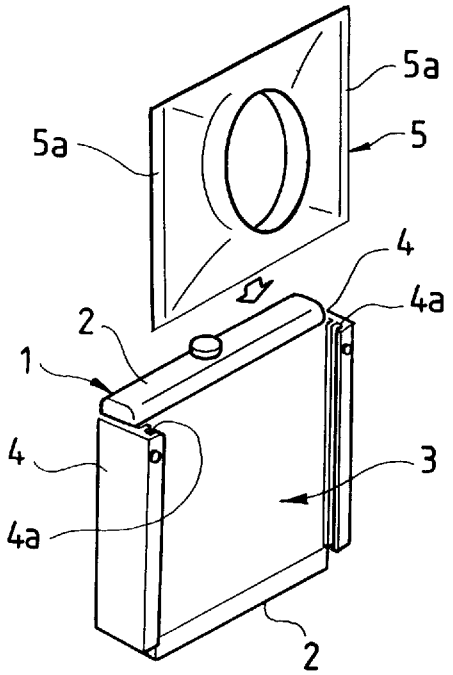
FIG. 5 PRIOR ART
FIG. 5 is an exploded view showing a conventional example of a structure for attaching a fan shroud to a heat exchanger.

FIG. 4 shows the details of the guide 47, and a resiliently-deformable lock protuberance 47 is formed at the leading end of the guide 47.

The lock protuberance 47*a* has a triangular hook and is integrally formed on the guide 47.

A pair of fitting protuberances 47*b* which resiliently fit, respectively, into the guide grooves 35*a* of the second tank body 35 are integrally formed in the guide 47 so as to be spaced at a given distance from each other.

The fitting protuberance 47*b* has a triangular shape, and a triangular hole 47*c* is formed at the center of the fitting protuberance 47*b*.

In the pair of second heat exchanger tanks 19 of the foregoing structure for attaching a fan shroud to a heat exchanger, the guide grooves 35*a* are integrally formed in the respective sides of the second tank bodies 35 facing to each other, and the guides 47 of the fan shroud 9 are inserted into the guide grooves 35*a,* respectively. As a result, the fan shroud 9 is attached to the heat exchanger.

When the leading end of the guide 47 of the fan shroud 9 is inserted into the guide groove 35*a* of the second tank body 35, the lock protuberance 47*a* is inserted into the guide groove 35*a* while remaining in a depressed and resiliently-deformed state. The insert stop 9*d* provided at the rear end of the fan shroud 9 comes into contact with the end face of the core 17 at the end of the inserting action, the lock protuberance 47*a* is held by the end face of the second tank body 35 protruding from the guide groove 35*a*.

In the pair of second heat exchanger tanks 19 of the structure, the structure being used for attaching a fan shroud to a heat exchanger and having the foregoing structure, the guide grooves 35*a* are integrally formed in the respective sides of the second tank bodies 35 facing to each other, and the guide 47 to be guided into the guide groove 35*a* of the second tank body 35 is integrally formed on each side of the fan shroud body 9*a* of the fan shroud 9 facing the second heat exchanger tank 19. Accordingly, the fan shroud 9 can be readily and reliably attached to the integral heat exchanger 7 without involving an increase in the number of components.

The resiliently deformable lock protuberance 47*a* is formed at the leading end of the guide 47 of the fan shroud 9, and the insert stop 9*d* is provided at the rear end of the fan shroud 9. As a result, the fan shroud 9 can be readily and reliably prevented from moving in the direction of the guide groove 35*a*.

In the foregoing structure for attaching a fan shroud to a heat exchanger, the fitting protuberances 47*b,* which resiliently fit into the guide groove 35*a* of the second tank body 35, are formed in each of the guides 47 of the fan shroud 9. Therefore, the fan shroud 9 can be readily and reliably prevented from oscillating.

In the foregoing structure of attaching a fan shroud to a heat exchanger, each of the first and second tank bodies 33 and 35 is integrally formed from aluminum by extrusion molding, and hence the guide grooves 35*a* can be readily and reliably formed during the extrusion molding operation.

Although the explanation has described an example in which the present invention is applied to the integral heat exchanger 7 comprising the radiator 11 and the condenser 13 in the previous embodiment, the present invention is not limited to the aforementioned embodiment. For example, the present invention can also be applied to a heat exchanger comprising solely a radiator.

Although the explanation has described an example in which the insert stop 9*d* is provided at the rear end of the shroud body 9*a* in the previous embodiment, the present invention is not limited to the present embodiment. For example, the insert stop may be formed at the rear end of the guide 47.

Further, although the explanation has described an example in which the present invention is applied to a motor fan shroud, in the previous embodiment, the present invention is not limited to such an embodiment. For example, the present invention may be applied to an engine shroud.

Although the explanation has described an example in which the guide grooves 35*a* are formed, respectively, in the sides of the second tanks 35 of the pair of second heat exchanger tanks 19 facing each other in the previous embodiment, the present invention is not limited to the present embodiment. The guide groove may be formed in the second tank body 35, e.g., the surface of the second tank body 35 opposite to the first tank body 33.

As has been described previously, in a structure for attaching a fan shroud to a heat exchanger according to the present invention, guide grooves are integrally formed in the respective sides of tank bodies of a pair of tanks, and a guide to be guided into the guide groove of the tank body is formed on each side of a fan shroud facing the tank. Accordingly, the fan shroud can be readily and reliably attached to the integral heat exchanger without involving an increase in the number of components.

In a structure for attaching a fan shroud to a heat exchanger according to the present invention, a resiliently deformable lock protuberance is formed at the leading end of the guide of the fan shroud, and an insert stop is provided at the rear end of the fan shroud. As a result, the fan shroud can be readily and reliably prevented from moving in the direction of the guide groove.

In the foregoing structure for attaching a fan shroud to a heat exchanger according to the present invention, fitting protuberances, which resiliently fit into the guide groove of the second tank body, are formed in each of the guides of the fan shroud. Therefore, the fan shroud can be readily and reliably prevented from oscillating.

In the foregoing structure of attaching a fan shroud to a heat exchanger according to the present invention, each of the tank bodies is integrally formed from aluminum by extrusion molding, and hence the guide groove can be readily and reliably formed during the extrusion molding operation.

What is claimed is:

1. A structure for attaching a fan shroud for covering a core formed between a pair of tanks which are spaced a given distance away from and opposite to each other so as to form a heat exchanger, comprising:

a guide groove being formed integrally in a tank body forming each of said pair of tanks; and guides being formed on both sides of said fan shroud facing said pair of tanks respectively.

2. The structure according to claim 1, wherein said guide of the fan shroud comprises a resiliently deformable lock protuberance formed at a leading end of said guide, and the fan shroud has an insert stop formed at a rear end of the fan shroud.

3. The structure according to claim 2, wherein said guide of the fan shroud comprises a resiliently deformable fitting protuberance for resiliently fitting into said guide groove of said tank body.

4. The structure according to claim 4, wherein each of said tank bodies with said guide groove is integrally formed from aluminum by extrusion molding.

5. The structure according to claim 2, wherein each of said tank bodies with said guide groove is integrally formed from aluminum by extrusion molding.

6. The structure according to claim 1, wherein said guide of the fan shroud comprises a resiliently deformable fitting protuberance for resiliently fitting into said guide groove of said tank body.

7. The structure according to claim 3, wherein each of said tank bodies with said guide groove is integrally formed from aluminum by extrusion molding.

8. The structure according to claim 1, wherein each of said tank bodies with said guide groove is integrally formed from aluminum by extrusion molding.

* * * * *